US010696453B2

(12) United States Patent
Sena

(10) Patent No.: US 10,696,453 B2
(45) Date of Patent: Jun. 30, 2020

(54) COLLAPSIBLE FOLDING CONTAINER

(71) Applicant: AH HA! ENTERPRISES, LLC, Deming, NM (US)

(72) Inventor: Paul David Sena, Raton, NM (US)

(73) Assignee: AH HA! ENTERPRISES, LLC, Deming, NM (US)

( * ) Notice: Subject to any disclaimer, the term of this patent is extended or adjusted under 35 U.S.C. 154(b) by 0 days.

(21) Appl. No.: 16/253,132

(22) Filed: Jan. 21, 2019

(65) Prior Publication Data

US 2019/0225375 A1 Jul. 25, 2019

Related U.S. Application Data

(60) Provisional application No. 62/619,772, filed on Jan. 20, 2018.

(51) Int. Cl.

| | |
|---|---|
| ***B65D 21/08*** | (2006.01) |
| ***A47G 29/20*** | (2006.01) |
| ***A47G 29/14*** | (2006.01) |
| *B65D 6/18* | (2006.01) |

(52) U.S. Cl.

CPC ..... *B65D 21/086* (2013.01); *A47G 29/141* (2013.01); *A47G 29/20* (2013.01); *B65D 7/26* (2013.01); *B65D 11/1853* (2013.01)

(58) Field of Classification Search

CPC ..... A47G 29/141; A47G 29/20; A47G 29/14; A47G 29/16; A47G 2029/144; A47G 2029/148; B65D 21/086; B65D 7/26; B65D 9/14; B65D 11/186

USPC ..... 232/1 E, 19, 38; 220/4.28, 4.29, 476, 220/480

See application file for complete search history.

(56) References Cited

U.S. PATENT DOCUMENTS

| | | | | |
|---|---|---|---|---|
| 1,673,769 | A | 6/1928 | Graham | |
| 1,915,980 | A * | 6/1933 | Craft | A47G 29/12 232/19 |
| 2,456,479 | A * | 12/1948 | Antil | A47G 29/14 220/6 |
| 2,669,385 | A * | 2/1954 | Curcio | A47G 29/20 232/42 |
| 6,032,815 | A | 3/2000 | Elstone | |
| 6,426,699 | B1 * | 7/2002 | Porter | A47F 10/00 221/2 |
| 6,967,575 | B1 | 11/2005 | Dohrmann et al. | |
| 8,342,347 | B2 | 1/2013 | Hay | |
| 10,321,780 | B1 * | 6/2019 | James | A47G 29/16 |
| 2001/0040422 | A1 * | 11/2001 | Gramlich | A47G 29/141 312/234 |

(Continued)

*Primary Examiner* — William L Miller
(74) *Attorney, Agent, or Firm* — Kramer Law Firm, P.C.; Kameron W. Kramer

(57) ABSTRACT

A collapsible folding container to provide a safe and secure location for delivered packages, comprising a base panel that is securably attached to a base frame, the base frame that is vertically mountable on a structure that is permanently hinged to the rear edges of a left side rear panel, a right side rear panel, a lid, and a bottom plate, a front panel permanently hinged to the front edges of the left side front panel and right side front panel, the left side rear panel permanently hinged to the rear edge of the left side front panel, and the right side rear panel permanently hinged to the rear edge of the right side front panel.

3 Claims, 4 Drawing Sheets

(56) References Cited

U.S. PATENT DOCUMENTS

| | | | | |
|---|---|---|---|---|
| 2002/0148889 | A1* | 10/2002 | Vogel | G07C 13/02 232/2 |
| 2003/0006275 | A1* | 1/2003 | Gray | A47G 29/14 232/19 |
| 2004/0256449 | A1* | 12/2004 | Stagnaro | A47G 29/12 232/28 |
| 2016/0331171 | A1* | 11/2016 | Jiang | G06Q 10/0833 |
| 2017/0188737 | A1* | 7/2017 | Hippert | A47G 29/20 |
| 2018/0228310 | A1* | 8/2018 | Enobakhare | A47G 29/1207 |
| 2018/0296016 | A1* | 10/2018 | Teoh | A47G 29/20 |

* cited by examiner

COLLAPSIBLE FOLDING CONTAINER

CROSS-REFERENCE TO RELATED APPLICATION

This application claims the benefit of U.S. Provisional Patent Application Ser. No. 62/619,772 filed Jan. 20, 2018, titled "Collapsible Folding Container" and the subject matter thereof is incorporated herein by reference thereto.

TECHNICAL FIELD

This invention is directed to the field of shipping, storage, and delivery of materials, and more particularly to a container for storing objects and materials that is collapsible.

BACKGROUND ART

Home shipments are increasing. Practically anything can be purchased online now. Amazon, eBay, and other online retailers offer everyday necessities, electronics, entertainment items, jewelry, collectibles, pharmaceuticals, etc. Thus, more and more people are relying on online retailers for products, greatly increasing the frequency of delivery for many people. Many of these items are delivered during the day while many people are at work. Unfortunately, "porch pirates" prey on these packages, and have even been seen following delivery trucks and simply walking up to the porch and taking the package as soon as the delivery person drives away.

There have been some methods used to prevent these thefts, such as holding packages as the post office and mailboxes with locks. However, holding packages at the post office is a great inconvenience, and not all the packages are even being sent through the United States Postal Service (USPS). Regarding locks on mailboxes, some neighborhoods or complexes have centralized locking mail boxes that may accommodate packages, but these are only accessible by USPS personnel. And personal locking mailboxes typically only accommodate letter sided envelopes.

As a result, many packages are left on the porches of residences during the day while the intended recipients are at work or away from their homes. The packages can be left unattended for hours, all the while susceptible to being stolen.

U.S. Pat. No. 8,342,347 B2 describes a collapsible container with a sliding lock feature and removable side walls.

U.S. Pat. No. 6,967,575 B1 describes methods and apparatus for unattended pickups and deliveries. The lockable unit includes a complicated locking and unlocking system, but no foldable or collapsing receptacle.

U.S. Pat. No. 6,032,815 describes a collapsible box. The device does not seem to be easily mountable, it includes an inner sleeve, and differs substantially in ability to function and structure that not all the pieces are permanently connected, either via hinges or otherwise.

U.S. Pat. No. 1,673,769 describes a collapsible ballot box. The device is a portable, collapsible ballot box, intended to be taken to polling stations. It is not mountable, nor does it offer the same ability to function or ease of use.

None of the prior art fully addresses the problems resolved by the present invention. The present invention overcomes these limitations contained in the prior art by providing a collapsible container that is mountable, sturdy, easy to use, inexpensive, and weatherproof, that provides a safe and secure location for packages to be left unattended for later retrieval by the intended recipient.

Certain embodiments of the invention have other steps or elements in addition to or in place of those mentioned above. The steps or element will become apparent to those skilled in the art from a reading of the following detailed description when taken with reference to the accompanying figures.

DETAILED DESCRIPTION OF THE INVENTION

Figure 1:
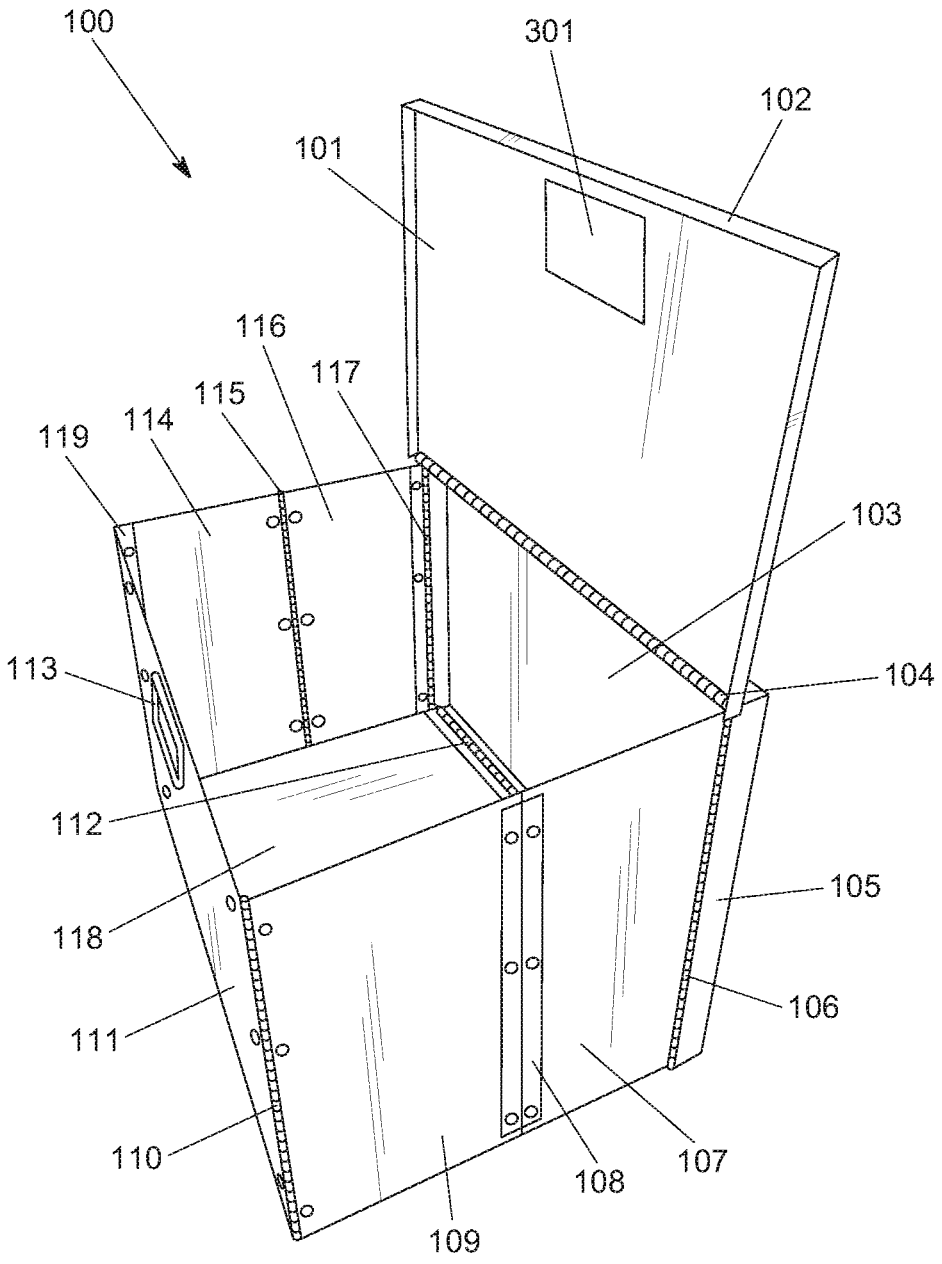
FIG. 1 is a perspective view of the collapsible container of the present invention in the open, fully extended assembled position.

The best mode for carrying out the invention will be described herein. The following embodiments are described in sufficient detail to enable those skilled in the art to make and use the invention. It is to be understood that other embodiments would be evident based on the present disclosure, and that system, process, or mechanical changes may be made without departing from the scope of the present invention.

In the following description, numerous specific details are given to provide a thorough understanding of the invention. However, it will be apparent that the invention may be practiced without these specific details. To avoid obscuring the present invention, some well-known system configurations, and process steps are not disclosed in detail. The figures illustrating embodiments of the system are semi-diagrammatic and not to scale and, particularly, some of the dimensions are for the clarity of presentation and are shown exaggerated in the drawing figures.

Alternate embodiments have been included throughout, and the order of such are not intended to have any other significance or provide limitations for the present invention.

For expository purposes, the term "horizontal" as used herein is defined as a plane parallel to the plane or surface of the collapsible container, regardless of its orientation. The term "vertical" refers to a direction perpendicular to the horizontal as just defined. Terms, such as "above", "below", "bottom", "top", "side", "higher", "lower", "upper", "over", and "under", are defined with respect to the horizontal plane, as shown in the figures.

The present invention comprises collapsible container that is mountable, sturdy, easy to use, inexpensive, and weatherproof, that provides a safe and secure location for packages to be left unattended for later retrieval by the intended recipient.

FIG. 1 is a perspective view of the collapsible container 100 of the present invention in the open, fully extended assembled position, ready to serve as a secure repository for a package. Collapsible container 100 comprises lid panel 101, base panel 103, base frame 105, front panel 111, right side front panel 109, right side rear panel 107, left side front panel 114, left side rear panel 116, and bottom panel 118. Lid panel is pivotally attached to the top of base frame 105 along a horizontal axis by top rear hinges 104. Bottom panel 118 is pivotally attached to the bottom of base frame 105 along a horizontal axis by bottom rear hinges 112.

Right side rear panel 107 is pivotally attached to base frame 105 along a vertical axis on the rear distal end by right side rear hinges 106. Right side rear panel 107 is pivotally attached to right side front panel 109 along a vertical axis by right side middle hinges 108. Right side front panel 109 is pivotally attached to front panel 111 along a vertical axis on the forward distal end by right side front hinges 110.

Left side rear panel 116 is pivotally attached to base frame 105 along a vertical axis on the rear distal end by left side rear hinges 117. Left side rear panel 116 is pivotally attached to left side front panel 114 along a vertical axis by left side middle hinges 115. Left side front panel 114 is pivotally attached to front panel 111 along a vertical axis on the forward distal end by left side front hinges 119.

Lid panel lip 102 extends around three sides of the distal edges of lid panel 101. Front handle 113 is connected to front panel 111.

Base panel 103 and base frame 105 can comprise one solid piece or can be a plurality of pieces as desired. If base panel 103 and base frame 105 are separate pieces, base frame 105 encompasses the entire outer edges of base panel 103, and base panel 103 and base frame 105 are both attached to a building or other structure via attachment means. Base panel 103 may be attached to base frame 105.

Figure 2:
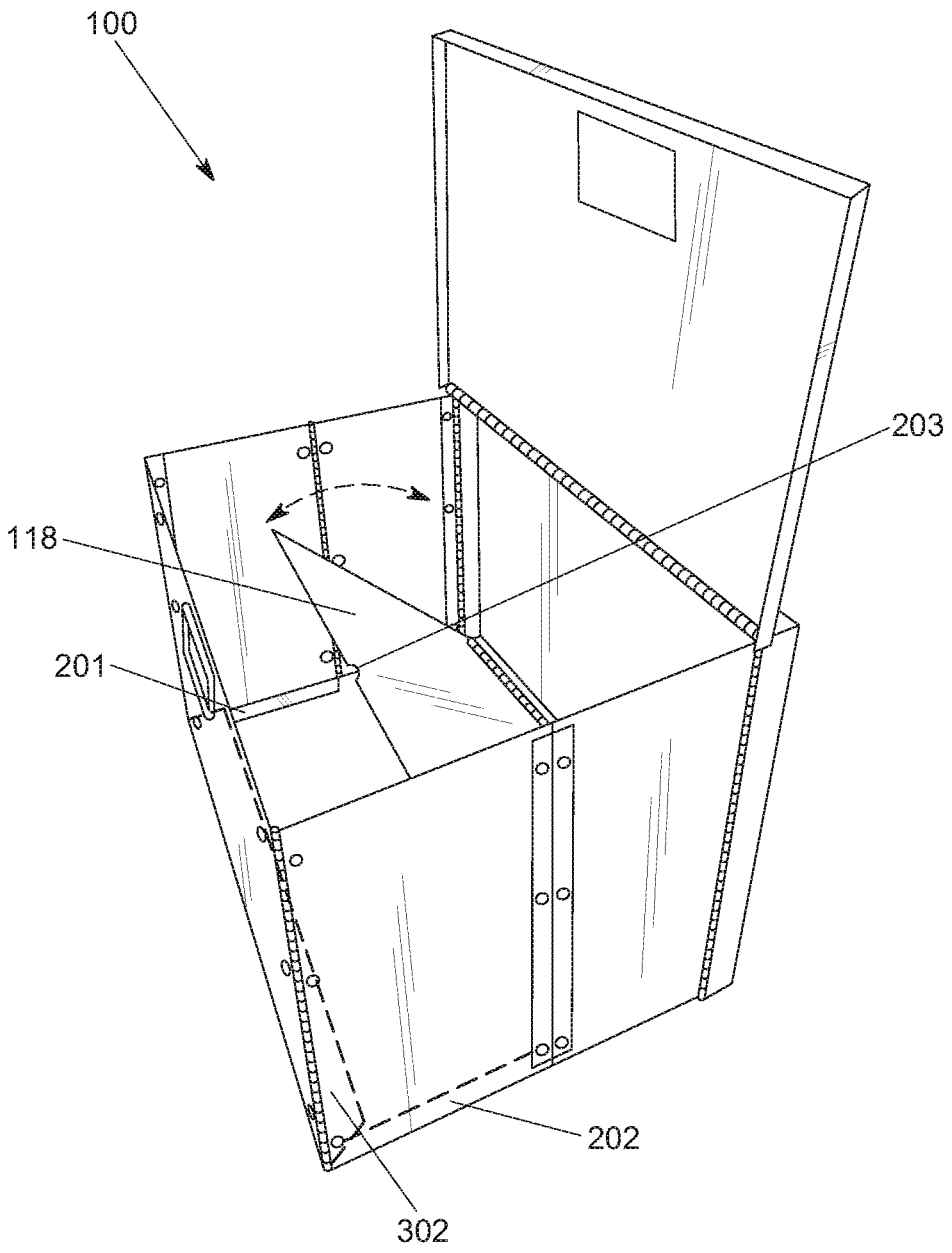
FIG. 2 is a perspective view of the collapsible container of the present invention in an open, partially assembled position.

FIG. 2 is a perspective view of the collapsible container 100 of the present invention in an open, partially assembled position. Bottom panel 118 is partially raised. Bottom panel access hole 203 allows for bottom panel 118 to be easily gripped in order to be raised and lowered. Left bottom lip 201 is disposed on the bottom distal edge of left side front panel 114. Right bottom lip 202 is disposed on the bottom distal edge of right side front panel 109. The arched arrow shows the movement of bottom panel 118.

Figure 3:
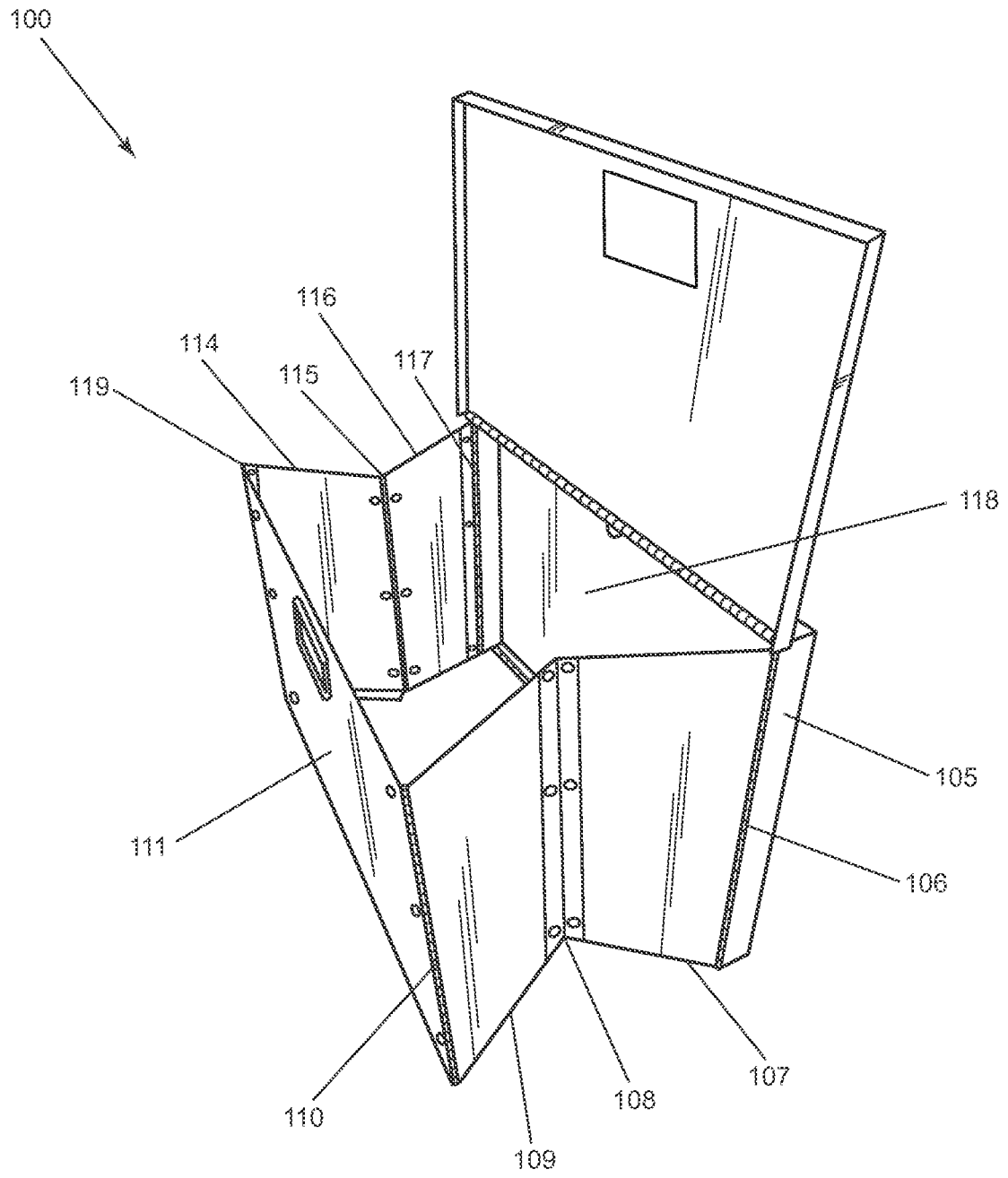
FIG. 3 is a perspective view of the collapsible container of the present invention in an open, partially folded position.

FIG. 3 is a perspective view of the collapsible container 100 of the present invention in an open, partially folded position. Bottom panel 118 is in the vertical position. Front panel 111 has been pushed toward the now vertical bottom panel 118, causing right side rear panel 107 and right side front panel 109 to angle inwards via right side middle hinges 108, right side rear hinges 106, and right side front hinges 110, and causing left side rear panel 116 and left side front panel 114 to angle inwards via left side middle hinges 115, left side rear hinges 117, and right side front hinges 119.

Figure 4:
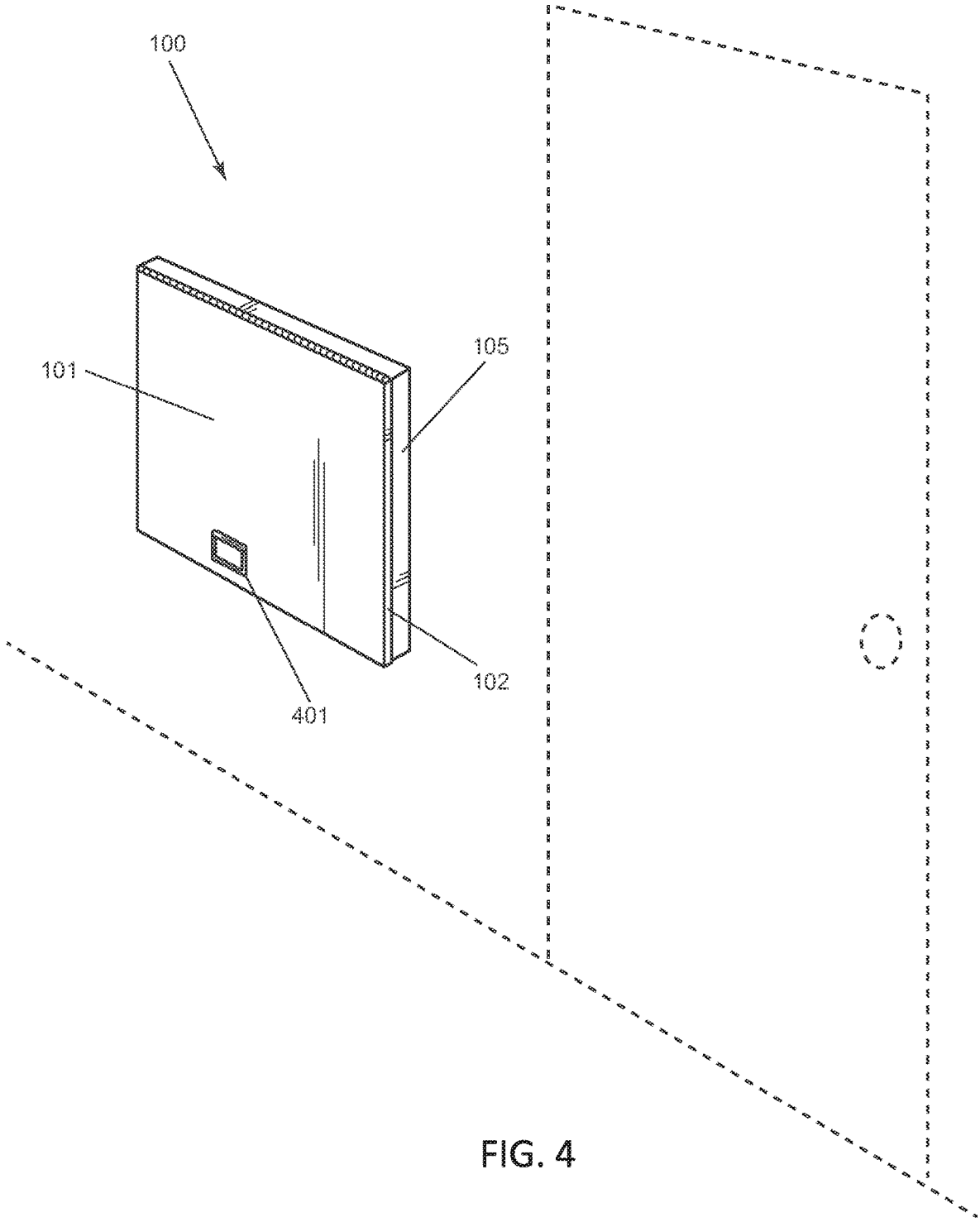
FIG. 4 is a perspective view of the collapsible container of the present invention in the closed position mounted to a structure.

FIG. 4 is a perspective view of the collapsible container 100 of the present invention in the closed position attached to a building or other structure. Base frame 105 is vertically attached to a wall of a building or other structure. Lid panel lip 102 sits snugly against base frame 105. Top handle 401 is connected to lid panel 101.

Base panel 103 and base frame 105 are securably attached to a building, wall, or other structure. When not in use, the collapsible container 100 is maintained in the closed position as shown in FIG. 4. Bottom panel 118 is disposed on base panel 103. Right side rear panel 107 and right side front panel 109, and left side rear panel 116 and left side front panel 114, are respectively folded together and disposed on bottom panel 118. Front panel 111 is disposed on right side front panel 109 and left side front panel 114. Lid panel 101 is disposed on front panel 111 to complete the enclosure.

To open the collapsible container 100, lid panel 101 is lifted using top handle 401 upward enough to allow front panel 111 to be pulled horizontally, straightening right side rear panel 107 and right side front panel 109, and left side rear panel 116 and left side front panel 114. Bottom panel 118 is lowered and is disposed on left bottom lip 201 right bottom lip 202. A package or other item can then be placed on the bottom panel 118. Lid panel 101 is pulled down, sealing the collapsible container 100.

The collapsible container 100 includes a locking mechanism 301, including but not limited to, a keypad, combination lock, electronic lock, spring loaded lock, or self-locking lock. The locking mechanism 301 can be connected wirelessly, thus having the ability to alert the recipient when the lock is engaged.

In one embodiment of the present invention, left bottom lip 201, right bottom lip 202, and bottom panel 118 have complimentary tongue and groove means.

In one embodiment of the present invention, a lip 302 is disposed on bottom distal edge of front panel 111, allowing bottom panel 118 to sit on the lip 302 when collapsible container 100 is in the open position as shown in FIG. 1. In one embodiment of the present invention, a lip or other means for supporting bottom panel 118 when collapsible container 100 is in the open position as shown in FIG. 1 are disposed on at least one of the bottom distal edges of front panel 111, left bottom lip 201, right bottom lip 202, left side rear panel 116, right side rear panel 107.

In one embodiment of the present invention, at least one of the bottom distal edges of the front panel 111, left side rear panel 116, left side front panel 114, right side rear panel 107, and right side front panel 109 have complimentary tongue and groove means with bottom panel 118.

In one embodiment of the present invention, at least one of the top distal edges of the left side rear panel 116, left side front panel 114, right side rear panel 107, and right side front panel 109 have complimentary tongue and groove means with lid panel 101.

In one embodiment of the present invention, bottom rear hinges 112 only allow bottom panel 118 to move no further than perpendicular to base panel 103.

In one embodiment of the present invention, base panel 103 and base frame 105 are attached horizontally to a structure or the ground.

In one embodiment of the present invention, there is no base panel 103, and base frame 105 can comprise one solid panel or can be a plurality of pieces as desired. If base panel 103 and base frame 105 are separate pieces, base panel 103 and base frame 105 are both attached to a building or other structure via attachment means.

In one embodiment of the present invention, all pieces comprising collapsible container 100 are spring operated, or other means, whereby upon opening lid panel 101 all other pieces automatically go into place to put collapsible container 100 in the open position shown in FIG. 1.

The best mode for carrying out the invention has been described herein. The previous embodiments are described in sufficient detail to enable those skilled in the art to make and use the invention. It is to be understood that other embodiments would be evident based on the present disclosure, and that system, process, or mechanical changes may be made without departing from the scope of the present invention.

In the previous description, numerous specific details and examples are given to provide a thorough understanding of the invention. However, it will be apparent that the invention may be practiced without these specific details and specific examples. While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations that fall within the scope of the included claims. All matters previously set forth herein or shown in the accompanying drawings are to be interpreted in an illustrative and non-limiting sense.

What is claimed is:

1. A collapsible container comprising:

a base panel that is securably attached to a base frame;

the base frame that is vertically mountable on a structure that is permanently hinged to rear edges of a left side rear panel, a right side rear panel, a lid, and a bottom panel;

a front panel permanently hinged to front edges of a left side front panel and a right side front panel;

the left side rear panel permanently hinged to a rear edge of the left side front panel;

the right side rear panel permanently hinged to a rear edge of the right side front panel; and lips positioned on inside bottom edges of the left side front panel and the right side front panel for supporting the bottom panel.

2. The collapsible container of claim 1 further comprising a locking mechanism, securing the lid to the front panel.

3. The collapsible container of claim 1 further comprising a lip on an inside bottom edge of the front panel.

* * * * *